11/11/86 OR 4,622,541

United States Patent [19]

Stockdale

[11] Patent Number: 4,622,541

[45] Date of Patent: Nov. 11, 1986

[54] INTRUSION DETECTION SYSTEM

[75] Inventor: Roy Stockdale, Halesite, N.Y.

[73] Assignee: Napco Security Systems, Inc., Copiague, N.Y.

[21] Appl. No.: 569,527

[22] Filed: Jan. 9, 1984

[51] Int. Cl.[4] ..... G08B 13/00; G08B 29/00

[52] U.S. Cl. ..... 340/566; 340/506; 340/512

[58] Field of Search ..... 340/566, 506, 507, 545, 340/512, 513; 200/61.45 R, 61.93

[56] References Cited

U.S. PATENT DOCUMENTS

| | | | |
|---|---|---|---|
| 3,641,547 | 2/1972 | Reiss et al. | 340/513 X |
| 3,866,202 | 2/1975 | Reiss et al. | 340/545 X |
| 3,962,696 | 6/1976 | Smith et al. | 340/566 X |
| 3,967,259 | 6/1976 | Lecuyer | 340/566 X |
| 4,275,391 | 6/1981 | Okamura | 200/61.45 R X |
| 4,361,740 | 11/1982 | Stockdale | 340/566 X |
| 4,385,288 | 5/1983 | Bitko | 340/566 X |
| 4,466,288 | 8/1984 | Grynberg et al. | 340/566 X |

FOREIGN PATENT DOCUMENTS

| | | | |
|---|---|---|---|
| 0005046 | 10/1979 | European Pat. Off. | 340/506 |
| 0011451 | 5/1980 | European Pat. Off. | 340/566 |
| 2109602 | 6/1983 | United Kingdom | 340/507 |

*Primary Examiner*—James L. Rowland
*Assistant Examiner*—Brian R. Tumm
*Attorney, Agent, or Firm*—Arthur L. Plevy

[57] ABSTRACT

There is disclosed an intrusion detection system employing vibration sensors which are arranged in a series loop consisting of first and second wires and which loop is terminated by a terminating impedance. Coupled to the wires is a processing circuit which supplies a square wave biasing waveform for the loop and a DC voltage determined by the terminating impedance. By detecting the magnitude of the DC level, the processor can determine if the loop has been opened or shorted or if any one of the sensors in the loop has been activated due to an intrusion. Thus the system described employs two wires for supplying both power and sensing of output signals from the loop being monitored.

21 Claims, 8 Drawing Figures

INTRUSION DETECTION SYSTEM

BACKGROUND OF THE INVENTION

This invention relates to intrusion systems in general and more particularly to an intrusion detection system which utilizes a plurality of vibration sensitive sensors arranged in a terminated loop.

The prior art is replete with a great many patents which essentially direct themselves to the detection of vibrations and convert the vibrations to an output signal to indicate an alarm condition. As is well known, in protecting a premises against unauthorized entry, the prior art employed various types of vibration sensitive detectors. These devices are placed and positioned on windows, doors, walls and so on and will produce an output upon a vibration of the structure exceeding a predetermined value. The output of such devices is normally detected by means of a processing circuit or other logic which enables a relatively reliable operation in that spurious vibrations or low magnitude vibrations are not responded to due to the protection circuitry.

A device which operates in such a manner is fully described in U.S. Pat. No. 4,361,740 entitled SEISMIC SENSOR APPARATUS, issued on Nov. 30, 1982 to R. Stockdale and assigned to the assignee herein. Essentially, the patent shows a sensor which employs an annular member having an interior conductive periphery. The annular member is coaxially positioned about a center post located in the housing. The interior periphery of the annular member engages two contacts, and when a vibration occurs, the annular member moves off the contacts to develop an output signal. This signal is detected to indicate an alarm by means of processing circuitry.

As indicated in the patent, there are many other devices in the prior art which also operate to detect vibrations and are widely utilized in intrusion alarm systems. In such an intrusion alarm system various sensors are normally connected in a series loop, and if one of the sensors or locations is vibrated, the loop is opened and the open circuit is detected by a processor or other control circuit to sound an alarm. There are, of course, many problems associated with this type of loop in that an intruder could conceivably short the loop at the control panel and hence prevent an alarm when he thereafter enters the premises.

There are other conditions which adversely affect the operation of such systems. It is, therefore, an object of the present invention to provide an intrusion system which employs vibration detectors in a series loop and which employs reliable processing circuitry in order to determine and indicate an alarm condition.

BRIEF DESCRIPTION OF THE PREFERRED EMBODIMENT

An intrusion detection system comprising a plurality of biasable sensing devices arranged in a two-wire loop, and each adapted when activated to provide a low impedance between the wires of said loop, processor means coupled to said wires and operative to supply a repetitive biasing potential waveform to said sensors and means associated with said processor means for monitoring said loop and responsive to said repetitive waveform for detecting said low impedance as affecting said waveform to provide an output signal indicative of an alarm condition.

DETAILED DESCRIPTION OF THE FIGURES

Figure 1:
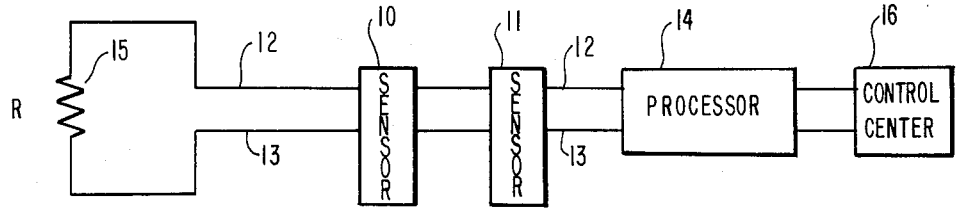
FIG. 1 is a simple block diagram of an intrusion detection system employing two-wire loop according to this invention.

Referring to FIG. 1, there is shown a simple schematic diagram of an intrusion detection system according to this invention.

Essentially, a plurality of sensors as 10 and 11 are wired into a loop which consists of two wires 12 and 13 and which wires terminate in a processing circuit 14. As will be explained, the function of the processor 14 is to detect an alarm condition and to supply operating potential for the sensors in the loop. The loop is terminated at its remote end by means of a resistor 15 which resistor is of a fixed and known magnitude and which as will be explained enables a certain voltage to appear on the loop which voltage change is detected to distinguish between an alarm condition or open loop condition.

The processor 14 is conventionally connected or coupled to a control center 16. The control center 16 may merely be a siren or other conventional audible alarm to indicate an intrusion or may actually be a control center capable of signalling to a remote location such as a security facility to thereby notify the police or other security personnel of an intrusion.

As shown in FIG. 1, the power supply for the sensors 10 and 11 is derived from the same two wires 12 and 13 which also carry the appropriate signals back to the processor 14.

Figure 2:
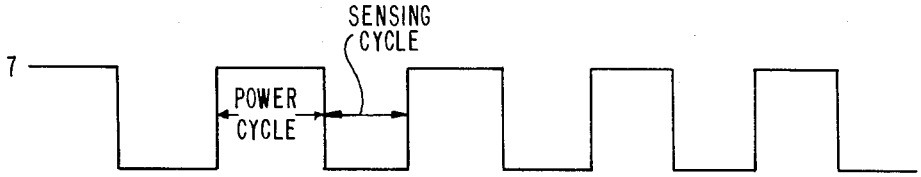
FIG. 2 is a timing diagram showing a square wave for applying power to the loop of FIG. 1.

Referring to FIG. 2, there is shown a timing diagram of the biasing voltage which is supplied on lines 12 and 13 to the sensors from the processor 14.

The two wires 12 and 13 of the sensor loop carry a square wave voltage which may be at a frequency of about 1 Khz and which provides power to the sensor circuits for half of the total time. This period is designated as the power cycle. During the off period between the power signals, the processor 14 will monitor the loop voltage in order to detect any output signal from the sensor which occured during the power period. As shown in FIG. 2, this time period is designated as the sensing cycle.

As indicated in FIG. 1, the sensing loop is terminated at the very end by the end-of-line resistor 15 which may, for example, be 787 ohms. The output impedance of the lines (in the sample schematic FIG. 4) during the sensing cylce is 2000 ohms, which means that under normal conditions, the loop voltage will alternate between the power cycle voltage of 7 volts, for example, and 2.00 volts during the sensing cycle.

Figure 3:
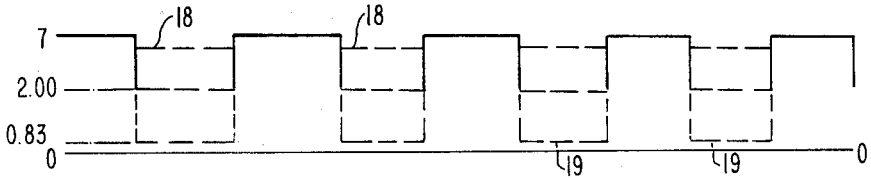
FIG. 3 is a timing diagram useful in explaining open and short circuit operation of the loop.

Referring to FIG. 3, there is shown a waveform indicating the voltage condition that can exist on the loop with the loop normal. This is shown in solid lines and is, of course, a square wave. If the loop is opened, which is indicated by the dashed line 18, a first potential appears which can be detected by the processor. This potential will appear if the loop is opened or if the terminating resistor 15 is not present.

As will be explained, if a sensor is activated, then this is determined by the voltage condition indicated by the dashed line 19 on the diagram of FIG. 3. This voltage will occur when one or more sensors 10 and 11 indicate an alarm condition. As seen in FIG. 1, the sensors as 10 and 11 are connected into the loop with two terminals and two additional terminals are used to connect the outgoing loop to the next sensor in line or to the end of line resistor 15. Thus the loop runs in and out of the sensor. Thus, it is not possible to cut a sensor out of the circuit. In order to eliminate a sensor, the sensor must be actually disconnected and the end of line resistor 15 allows a continuous monitor of loop and sensor conditions. In this manner as one can ascertain, the biasing which is supplied from the processor on the two lines also serves to indicate an alarm condition as in FIG. 3. Thus the two lines which are directed from the processor 14 to the sensors are utilized to provide both biasing and the detection of alarm conditions such as a loop open or a sensor activation as will be explained.

Figure 4:
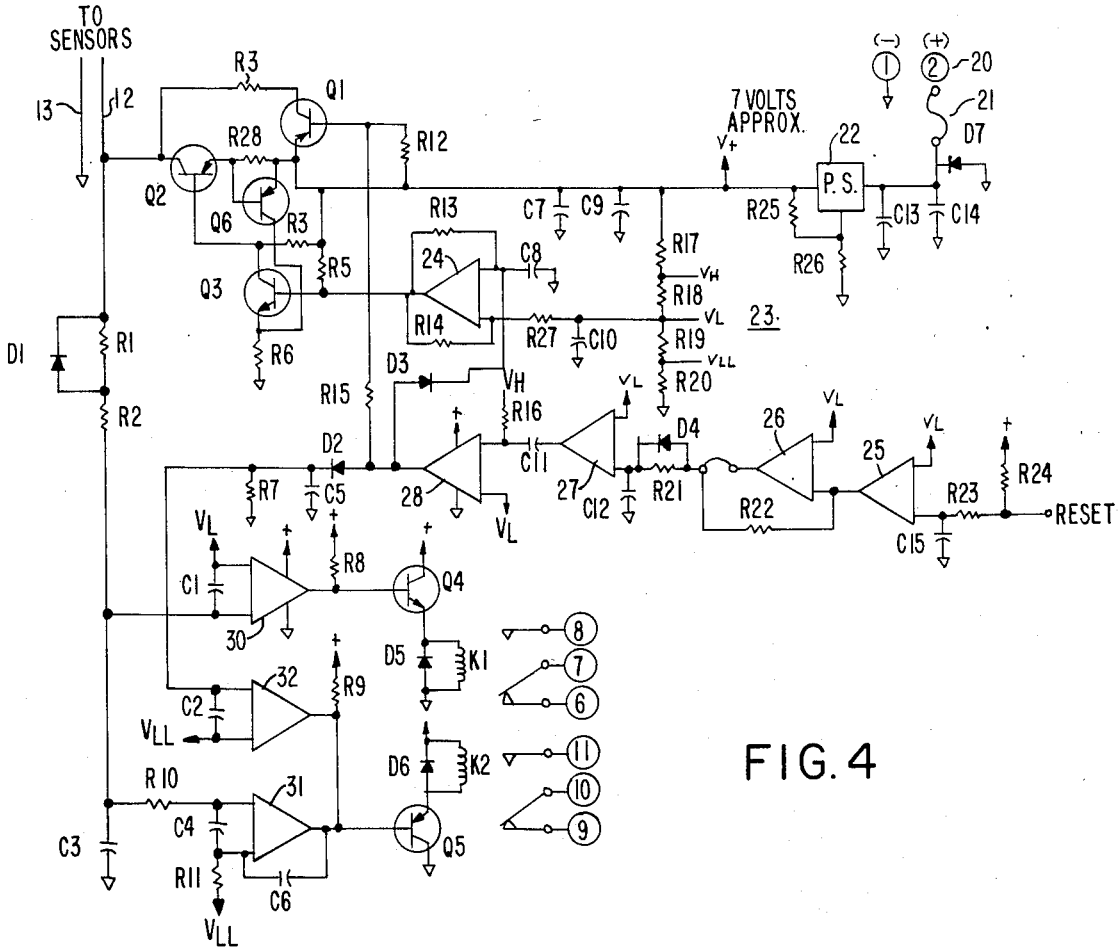
FIG. 4 is a detailed schematic diagram of a process or employed in this invention.

Referring to FIG. 4, there is shown a schematic diagram of a processing unit as, for example, unit 14 of FIG. 1. In the schematic diagram possible component values are included. An input battery supply is connected to terminal 20 designated by the + sign and is directed via a fuse 21 to the input of a regulated power supply module 22 (p.s.). The power supply module 22 is a conventional integrated circuit chip and is available from many sources and operates to supply a regulated output voltage V+ for the processor. Coupled to the output voltage V+ is a voltage divider 23 which supplies the various reference voltages to the comparators. The reference voltages are designated as $V_h$, $V_L$ and $V_{LL}$. The junction between resistors R18 and R19 is decoupled for stray R.F. by C10 and coupled to an input of an operational amplifier 24 which is arranged as an oscillator circuit. The frequency is determined by the feedback resistor R13, and resistors R14 and R27 provide positive feedback and hysteresis. In any event, the output of oscillator 24 produces a square wave and is coupled to the base electrode of transistor Q3. The collector electrode of transistor Q3 is directed to the base electrode of transistor Q2 which is a series pass transistor havings its collector electrode coupled to one line of the loop. This would be analogous to line 12, while the other side of the loop is a common reference designated as line 13. A further transistor Q6 operates to limit the output current to the loop to avoid damage if the loop is short circuited or over loaded. This is a fairly common protection scheme. Q1 is normally saturated and connects the output resistor R3 (2000 ohms) to set the bias level at the line terminating resistor.

As will be explained, the sensor circuits as 10 and 11 of FIG. 1 have an LED which will be latched under alarm conditions and which is reset from the processor when required. This occurs by switching off the outgoing power during the power cycle for a period of time which is about 1 second. This operation is afforded by the reset circuit. As shown in FIG. 4, a reset input is directed to one input of an amplifier 25 whose output is coupled to an input of amplifier 26. The input to the reset may be a positive or negative voltage. Amplifier 26 is provided for phase reversal, and for example, when a negative input voltage is used, the amplifier 26 is removed thus allowing the output of amplifier 25 to be connected to the input of amplifier 27. Amplifier 27 and amplifier 28 form a pulse generator which essentially provides a positive output pulse to inhibit the oscillator 24 from producing a square wave during the reset condition. Transistor Q1 (which is normally saturated by base current through R15) will be desaturated during this time to remove the bias from the loop. This effectively removes the power signal as indicated in FIG. 2 from the lines and serves to reset any sensor which was activated.

In series with the loop line 12 are resistors R1 and R2 with resistor R1 being shunted by diode D1. The above noted components couple the loop to comparators 30 and 31 which respectively sense the DC level voltage on the loop during the sensing cycle. Over voltage is sensed by comparator 30 which has the positive or non-inverting input coupled to the line 12 and has the inverting input coupled to $V_L$ which is the reference potential at the divider. The output of comparator 30 is coupled to the base electrode of transistor Q4 which is normally cut off. Transistor Q4 has a relay coil K1 coupled in series with the emitter electrode and the coil is activated when transistor Q4 is turned on. The relay coil K1 is associated with three contacts as shown. Hence if the loop voltage becomes excessively high, as for an open loop condition; or when the line terminating resistor 15 is removed, this condition will be sensed by comparator 30 and transistor Q4 will operate relay K1. Thus the user now has an indication that there is an open loop in the system and adequate repairs can be made or alarm condition indicated. Comparator 31 has the non-inverting input coupled to potential $V_{LL}$ which is a lower potential, and essentially the comparator 31 operates to detect a low voltage condition on the line which can be caused by a short circuited loop or an activated sensor.

The output of comparator 35 is coupled to the base electrode of transistor Q5 which is normally saturated or ON thus operating relay coil K2 associated with the three contacts. When comparator 31 detects a low voltage condition, transistor Q5 is turned off during loss of power. Amplifier 32 in conjunction with diode D2 operates to prevent the reset pulse from turning transistor Q5 off during a reset procedure. In any event, the above noted processor can operate to supply power in the form of a square wave to a control line, and by using comparators 30 and 31 can detect a low or a high voltage condition on the same control line to thus indicate an appropriate alarm condition via the relays K1 and K2.

Figure 5:
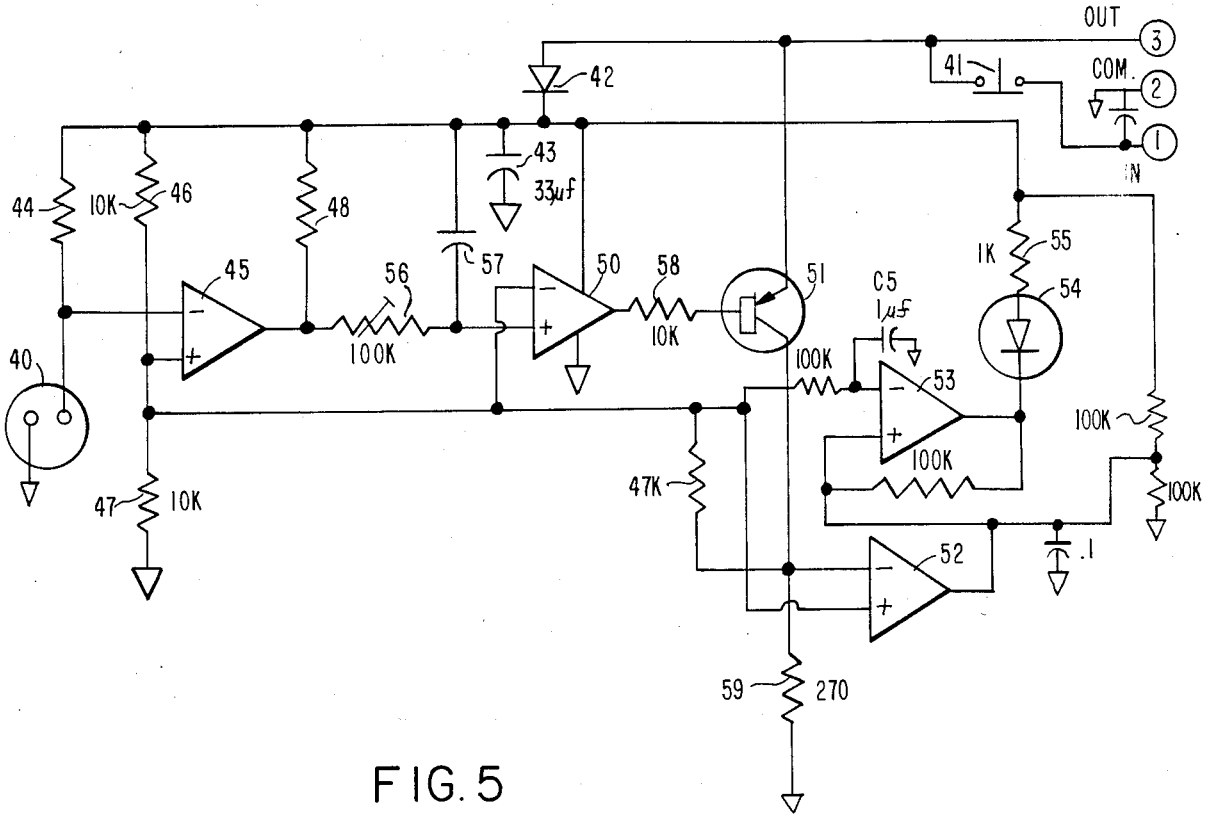
FIG. 5 is a detailed schematic diagram of a sensing circuit used in this invention.

Referring to FIG. 5, there is shown a schematic diagram of a typical vibration sensor circuit employed for sensors 10 and 11 of FIG. 1 and operating in conjunction with the processor of FIG. 4. The seismic sensor 40 contains an annular member which is of similar structure as depicted in U.S. Pat. No. 4,361,740. Essentially, the sensor contains an annular member with contacts supporting contacts, and when subjected to vibration, the annular member moves off the contacts to produce an output pulse. The duration of the pulse as well as the number of pulses is a function of the magnitude of the vibration. The sensor has an input terminal designated as IN to which line 12 is wired and a common terminal for connecting to line 13. The output or out terminal is connected to another sensor as is the common line to add as many sensors in the loop as necessary. Thus each sensor is connected as follows. The line 12 is connected to the IN terminal of the first sensor with the OUT terminal of this sensor connected to the IN termial of the next sensor and so on. In this manner the tamper switch 41 is in series with the line and each of the sensors, and hence if a sensor is tampered with by removal of the cover and so on, the line is broken; and this will be detected due to the fact that the terminating resistor 15 of FIG. 1 is removed from the circuit.

Thus the square wave signal is applied via terminal 1 through a tamper switch 41. The tamper switch 41 is a mechanical switch which is, as will be further explained, opens when the cover of the sensor device is removed. This will remove power from the sensor and cause an open loop condition to be detected by the processor. The square wave signal is applied via diode 42 in conjunction with capacitor 43 providing a DC operating voltage for the circuitry. The seismic sensor is biased via resistor 44 which is coupled to one input terminal of the sensor and also to one input terminal of a comparator 45. As indicated, the seismic sensor 40 contains a gold plated toroid or annular member which is supported on two of four gold plated contacts and a small loop current is conducted through the toroid via resistor 44 until it is vibrated to cause a current interruption due to the impact or vibration.

The comparator 45 has the other input or non-inverting input coupled to the junction between resistors 46 and 47 to set the voltage at which the sensor 40 will switch the comparator when vibrated. Thus the output of comparator 45 charges capacitor 57 via and adjustable resistor 56. Depending on the duration and number of pulses provided, capacitor 57 will charge as a function of the setting or adjustment of resistor 56. The combination of resistor 56, resistor 48 and capacitor 57 allows either single pulse charging of the capacitor 46 or integration of lower amplitude pulses. The amplitude of impact as indicated determines the duration of the output pulse from the comparator 45. By varying resistor 56, the user can set the level of vibration that is necessary to activate comparator 50. The comparator 50 has its inverting input coupled to the junction between resistors 46 and 47 and has its non-inverting input coupled to the junction between capacitor 57 and resistor 56. Thus when capacitor 46 charges, comparator 50 is switched on. The switching on of comparator 50 saturates transistor 51 via resistor 58. When transistor 51 is saturated, resistor 59 which is connected to the collector electrode is now connected across the output lines. This, of course, causes a drop in the output line impedance and is recognized by the processor as a low voltage condition.

A further comparator 52 has one input connected to the collector electrode of transistor 51 and the other input connected to the junction between resistors 46 and 47. This comparator will switch when transistor 51 is turned on. The switching of comparator 52 activates or switches comparator 53 to the ON condition. Comparator 53 is arranged in a latching circuit, and hence when activated by comparator 52, comparator 53 will latch causing the LED device 54 to activate through resistor 55. This LED device will remain ON as a memory indication that that particular sensor has tripped.

The LED 54 may be reset by removing the input lead to the unit or by operating the tamper switch 41 during service or by the generation of a reset pulse provided by the processor and as explained above. As one can understand, in normal field peration, the sensor circuit as shown in FIG. 5 which would be the sensors 10 and 11 of FIG. 1 if removed by cutting the sensor leads, would cause an alarm because of the opening of the entire loop. This condition would be detected immediately by the processor as shown in FIG. 4.

Figure 6:
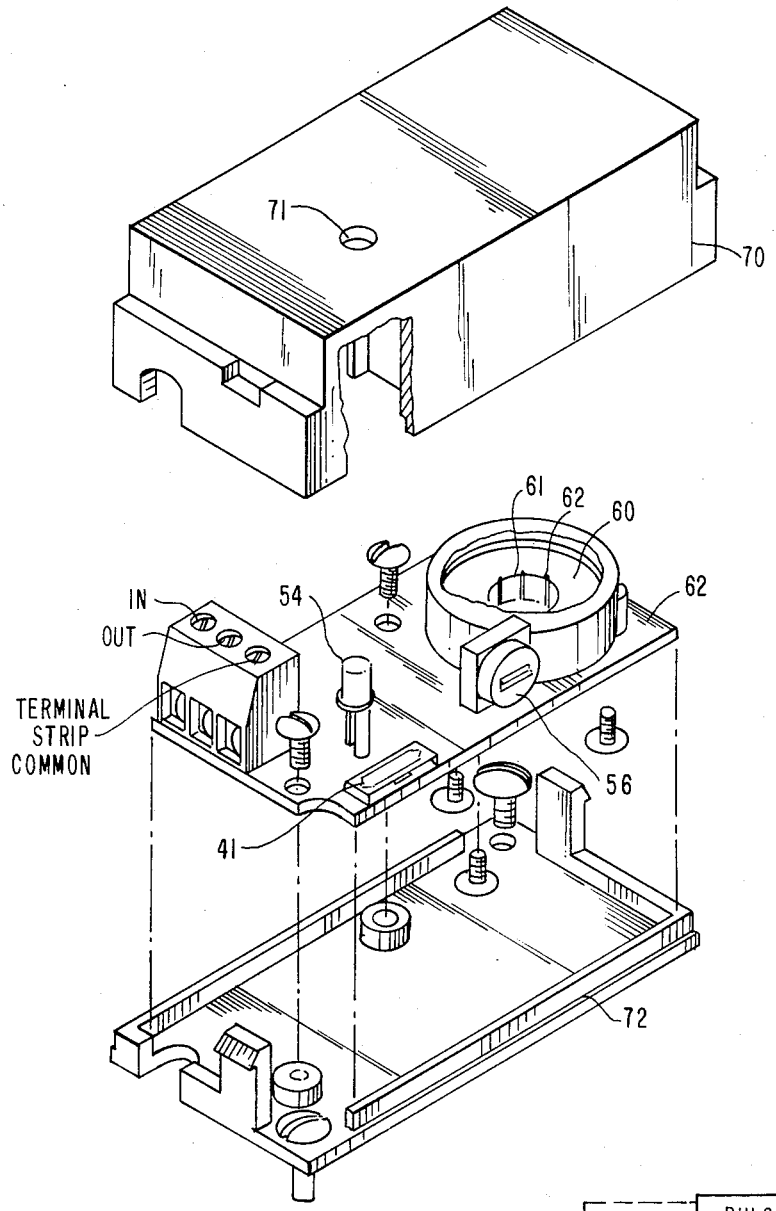
FIG. 6 is a mechanical assembly diagram of a sensor employed in this invention.

Referring to FIG. 6, there is shown a mechanical drawing depicting the housing for containing the sensor unit.

As shown in FIG. 6, the sensor 60 is a toroid which is in contact with extending posts 61 and 62. There are four such posts or pins which are used as contacts for the toroid 60 to allow operation in any one of four mounting planes. This aspect is described in the above noted patent. The pins are connected to a printed circuit board 62 which contains the circuitry shown in FIG. 5. The LED device 54 as shown in FIG. 5 is also mounted on the board. The tamper switch 41 is depicted and may be a microswitch which is positioned on the printed circuit board 62 such that the cover 70, when emplaced upon the printed circuit board, activates the switch 41 to close it. If the cover 70 is removed, the switch will open, thus disconnecting power from the module and causing the processor to detect an open line condition.

The cover plate has an aperture 71 which allows one to visualize the status of LED device 54 which operates as an alarm memory indicator. The resistor 56, as indicated, is a sensitivity adjust and is shown mounted on printed circuit board 62. The entire assembly as depicted in FIG. 6 is mounted on a base plate or a mounting base 72 and assembled together by means of the various screws as shown.

Figure 7:
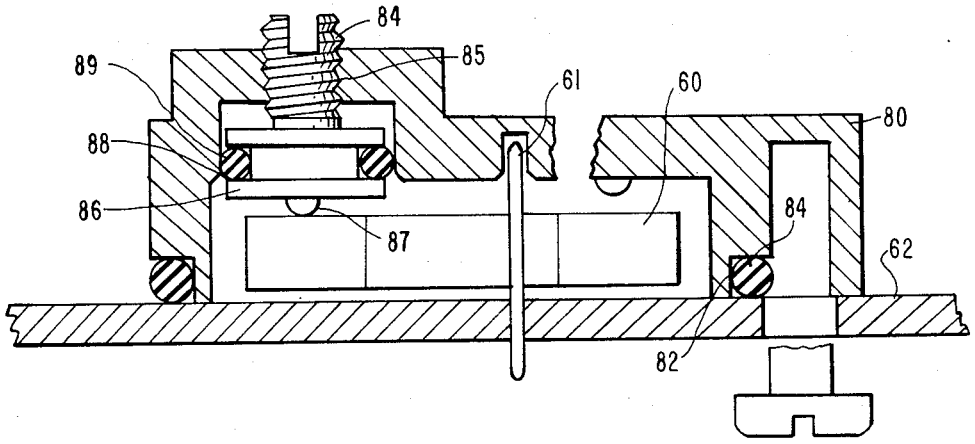
FIG. 7 is a cross sectional view of a vibration sensor and housing employed in this invention.

Referring to FIG. 7, there is shown a cross sectional view of the toroid or vibration sensor 60. The toroid is mounted within a sealed case 80. The posts as post 61 (FIG. 6) extend through the printed circuit board 62 where they serve as contacts for wiring to the various components as shown in FIG. 5. In any event, the housing 80 contains an internal flange 82 which contains an O-ring 84 which essentially allows for a hermetic and waterproof seal. As indicated in the above noted patent, the toroid 60 is gold plated for purposes of making optimum contact with the gold plated contact pins as 61. It has been determined that during transport, based on the excessive vibrations of the toroid, the gold plating may be scraped off and hence various areas of the toroid do not make proper contact. In order to solve this problem, there is shown in FIG. 7 an adjustable toroid locking screw 84. Screw 84 threadedly engages an aperture 85 within the housing 80, and its underend comprises a bobbin-like member 86. The member 86 has a bottom end 87 which contacts the surface of the toroid thereby restraining the toroid from moving during transit.

Located about a central groove 88 of member 86 is an O-ring 89. The O-ring 89 operates to maintain a good seal for the toroid structure. As one can see by adjustment of the screw 84, one can now restrain the toroid from moving to provide unnecessary wear on the gold plating due to the movement of the toroid during transit. When the sensor is installed, screw 84 is turned so that the toroid is no longer restrained during operation in the field.

Figure 8:
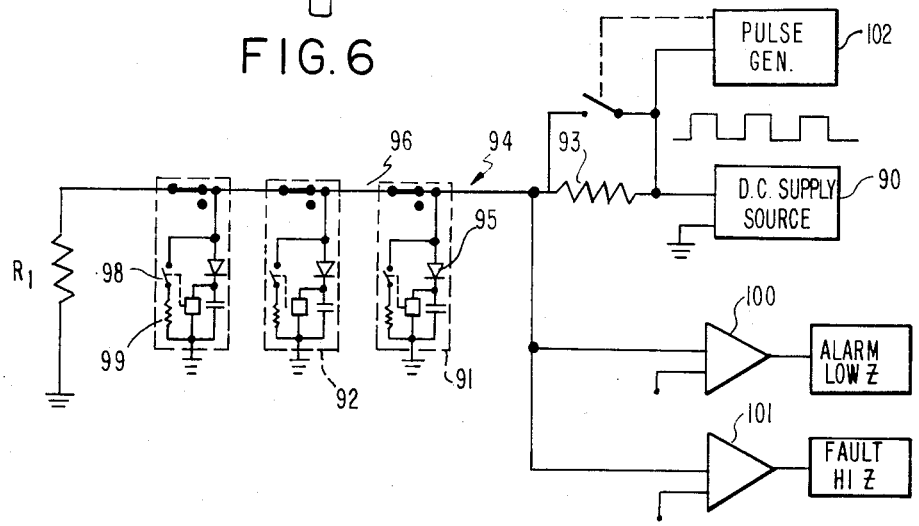
FIG. 8 is a simplified block diagram included to explain the operation of the intrusion detection system according to this invention.

With the above in mind, reference is now made to FIG. 8 where a simple circuit schematic is shown in order to gain a better understanding of the operation of the intrusion detection system. Referring to FIG. 8, there is shown the DC supply source 90. Essentially, the DC supply 90 is switched by a pulse generator 102 to produce the square wave and is analogous to the pulse generator 24 and the drive circuitry shown in FIG. 4. The drive, as indicated, supplies the square wave and a direct current through 93 to the two lines. The sensors as 91 and 92 are shown enclosed by dashed lines and are schematic equivalents.

A resistor 93 is shown in series with the DC supply source 90 and the first of the two wire lines 94. The pulse generator shunts the resistor repetitively at the oscillator frequency with an electronic switch. The other line, of course, is the common line. As can be seen from the above, the drive source which is a positive transition via the diode 95 associated with the sensor. For example, the diode 42 of FIG. 5 is analogous to diode 95 of FIG. 8 and rectifies the positive cycle to produce a DC voltage across the capacitor 43 of FIG. 5 which voltage is used to energize or supply operating power to the sensor. This, of course, is the power cycle.

The line terminating resistor R is, of course, included within each loop and is a necessary part. Each of the sensors as indicated is connected one another through the tamper switch associated with each sensor which is switch 41 of FIG. 5 and, for example, switch 96 of FIG. 8. The switch is shown in a normally closed position. If a sensor were removed, one would have to remove the cover to gain access to the terminal board. Once the cover is removed, the switch 96 would open, thus disconnecting the remainder of the line including the terminating resistor from the processing circuit or from the drive source. This can be seen by referring to FIG. 5 where each sensor is wired so that one side of the line; namely, the input of the line, is directed through the tamper switch 41 to the output (OUT) terminal which is connected to the next IN terminal of the following sensor. Thus during the power cycle, biasing voltage is applied via the diodes to each of the sensors.

If the sensor indicates an alarm, then the associated transistor designated by switch 98 closes which places the impedance 99 in parallel with the line terminating resistor R. This effectively loads down the voltage at junction of resistor 93 and the line terminating resistor R as seen in FIG. 8. If no sensor is activated, then during the sensing cycle, the diode D1 of FIG. 4 is foward biased and the circuit sees only the potential formed by resistors 93 and R, the line terminating resistor of FIG. 8 which is resistor R2 of FIG. 4. This then causes a specified residual DC voltage which is then determined by the ratio of the two resistors 93 and R to be present at the input terminals of comparators 100 and 101. Since this voltage is anticipated, no alarm condition will be indicated. In any event, if a sensor is activated and the switch 98 closes, then the effective impedance has changed, and therefore, the residual DC voltage is now lower. The lower voltage condition is detected by comparator 100 which indicates an alarm, and this occurs during the sensing cycle. This alarm indicates that a sensor has been activated as indicated in FIG. 8.

If on the other hand, the terminating resistor R were removed or the line was opened via the switch 96, then the voltage would rise and this condition would be detected by the comparator 101 indicating that the line is broken which will enable one to make repairs during the day time operation or may indicate a separate alarm for night time indication. Thus as seen in the simplified diagram of FIG. 8, the system operates by monitoring the magnitude of the voltage on the line during the sensing cycle there if the voltage is low, it manifests an intrusion condition, and if the voltage is high, it manifests that the line has been broken. Hence in this manner one can utilize the same exact line for supplying operating power, for receiving alarm signals from the intrusion system, and for monitoring the condition of the lines.

It is indicated that the above system, which includes the processor module, can monitor and activate up to 50 sensors. Each sensor is an adjustable tamper protected two-wire seismic sensor which functions to aid in the protection of windows and walls. Each sensor consists of a gold plated toroid which is mounted on a printed circuit board which also contains the electronic circuitry as well as a light emitting diode and a tamper switch. The processor provides a square wave output voltage for the loop which connects and supplies power for the sensors and responds to alarm signals from any of the sensors by monitoring the residual DC voltage level of the square wave. As a sensor is operated, it places an impedance across the line to lower the residual DC level of the square wave voltage which is detected by the processor. Due to the wiring of the sensors in the loop, if a sensor is removed, then this increases the residual DC level which is also detected by the processor.

I claim:

1. An intrusion detection system, comprising:

first and second lines with one of said lines being a common, a plurality of sensors arranged in parallel between said lines, with each sensor including unidirectional rectifying means for providing a DC operating potential to each sensor upon application to said first line of a potential of a given polarity, with each sensor further including latching means responsive to sensor operation to provide a given impedance across said lines when said sensor is operated due to an intrusion, a terminating impedance arranged in parallel with said sensors between said lines, driving means coupled between said lines and operative to provide a repetitive waveform characterized in having a first cycle indicative of a first transititon period and a second cycle indicative of a second transition period, whereby said unidirectional rectifying means is responsive to said first cycle to provide said operating potential to said sensors, processing means coupled to said first line and operative to provide a first impedance during said first cycle and a second impedance during said second cycle of said repetitive waveform said processing means including detection means operative during said second cycle to detect the voltage on said loop as determined by said second impedance, said line terminating impedance and said given impedance whereby if a sensor is operated due to an intrusion, said processing means detects a low voltage condition during said second cycle, whereby if said line terminating impedance were removed said processing means detects a high voltage condition during said second cycle in accordance with the expected ratio of said line terminating impedance and said given impedance as compared to said second impedance, with said first impedance of said processing means being of a value to prevent the operation of said detection means during said first cycle.

2. The intrusion detection system according to claim 1, wherein said detection means includes a first comparator having one input coupled to a first reference level indicative of a low line voltage with a second input coupled to one of said lines to provide an output when said line voltage falls below a predetermined value and a second comparator having one input coupled to a second reference level indicative of a high line voltage with a second input coupled to said one line to provide an output when said line voltage exceeds a give value.

3. The intrusion detection system according to claim 2, further including alarm generating means coupled to the outputs of said first and second comparators to provide an output alarm indicative of said low or high value condition.

4. The intrusion detection system according to claim 1, wherein said processing means as coupled to said line includes a first resistor shunted by a diode having a polarity to conduct during said second cycle to thereby effectively bypass said resistor during said second cycle indicative of said second impedance and to be reversed biased during said first cycle indicative of said first impedance.

5. An intrusion detection system, comprising:

first and second lines, at least one sensor arranged between said lines, with said sensor having an input terminal connected to one of said lines, with said input terminal coupled to unidirectional rectifier means and operative upon receipt of a given polarity signal to provide an operating potential for said sensor, and means associated with said sensor to provide upon the detection of an intrusion a low impedance across said lines, a line resistor in parallel with said sensor and across said lines, a drive source coupled to said input terminal for providing a repetitive waveform, with said waveform having a first cycle indicative of a first polarity period and a second cycle indicative of a second polarity period, whereby said unidirectional biasing means provides said operating potential to said sensor for said first cycle, processing means coupled to said input terminal and operative only during said second cycle to detect any change in impedance across said lines during said second cycle, and wherein when said change of impedance is due to an intrusion said sensor provides said low impedance and this condition is detected by said processing means.

6. The intrusion detection system according to claim 5, wherein said change of impedance will also result due to the effective removal of said line resistor.

7. The intrusion detection system according to claim 5, wherin said repetitive waveform is a square wave having a given repetition rate.

8. The intrusion detection system according to claim 5, wherein there is a plurality of sensors arranged in said two-wire loop with each sensor having an input terminal for receiving said biasing potential with said input terminal connected through a normally closed tamper switch to an output terminal, with the output terminal of a first sensor connected to the input terminal of a second sensor and so on with one of said input terminals coupled to said processing means to receive said repetitive waveform.

9. The intrusion detection system to claim 5, wherein said sensor is a seismic sensor including a toroidal member supported by at least two contact pins and operative to move off said pins upon application thereto of a predetermined vibration, to provide an output pulse of a magnitude dependent upon the magnitude of said vibration and means responsive to said output pulse to provide said low impedance.

10. The intrusion detection system according to claim 9, wherein said sensor is contained in a housing with said housing including selectively operated means for restraining the movement of said toroid.

11. The intrusion detection system according to claim 9, wherein said sensor further includes means for adjusting the sensitivity of said sensor by monitoring the duration of and/or the number of said output pulses.

12. An intrusion detection system, comprising:

first and second lines with one of said lines being a common, a plurality of biasable sensors each having an input terminal for receiving an input and at output terminal coupled to said input terminal via a normally closed tamper switch, whereby said first line is connected to said input terminal of said first sensor and the output terminal of said first sensor is connected to the input terminal of said next sensor and so on with a terminating resistor connected to the output terminal of said last sensor to form a loop, with each of said sensors operative to provide a low impedance in shunt with said terminating impedance upon detection of an intrusion to thereby shunt said terminating impedance upon the occurrence of said intrusion with each of said sensors including unidirectional rectifying means coupled to said input terminal and operative to provide a biasing signal for said sensor when energized by a given polarity signal from a repetitive waveform applied as said input, driving means coupled to said input terminal of said first sensor and operative to supply said repetitive waveform as said input to said sensors for biasing the same, said repetitive waveform having a first given cycle and a second given cycle each of a different polarity, whereby said sensors are biased during said first given cycle, first means operative during said second given cycle and coupled to said line responsive to the operation of one of said sensors providing said shunting impedance as affecting the resistance ratio of said line to indicate an alarm condition and second means operative during said second given cycle coupled to said line and responsive to the opening of said line manifesting the removal of said terminating impedance to thereby provide an indication of an open circuit condition.

13. The intrusion detection system according to claim 12, wherein said repetitive waveform is a square wave and said first given cycle is a positive transition portion of said square wave, with said second given cycle being the negative duration portion of said square wave.

14. The intrustion detection system according to claim 12, wherein each sensor is further associated with separate indicating means operative to provide a visual output signal when said sensor detects an intrusion.

15. The intrusion detection system according to claim 12 wherein each of said sensors is a seismic sensor including a movable toroid supported on at least two contacts and operative when vibrated to move off said contacts to provide an output pulse indicative of said vibration, and means responsive to said pulse to provide said low impedance.

16. The intrusion detection system according to claim 15, wherein each of said sensors is located in a separate housing having a removable cover, with said tamper switch coacting with said cover and held in said normally closed position, whereby when said cover is removed said switch opens to cause said line to open whereby said second means detects this condition.

17. The intrusion detection system according to claim 16 further including selectively operated means coupled to said housing and operative to contact said toroid to prevent said toroid from moving.

18. A biasable sensor circuit for use in detecting an intrusion by placing said sensor circuit in a loop which has impressed upon a line of said loop a repetitive waveform for application to an input terminal of said sensor circuit, said sensor circuit comprising:

an input terminal coupled to said line and adapted to receive said repetitive waveform, a rectifier coupled coupled to said input terminal and operative to rectify said waveform to provide a DC potential, means for applying said DC potential to said sensor to bias the same, means responsive to the operation of a sensor device to provide an output when said sensor device detects an intrusion, said sensor device taking the form of a seismic sensor including an annular member supported by two contacts through which said bias potential is applied, with said annular member capable of moving off at least one contact to provide an opening of said bias potential indicative of a pulse, comparator means coupled to said sensor device and responsive to said pulse to provide said output when said sensor is vibrated, a controllable impedance device having one terminal coupled to said line and another terminal coupled to a point of reference potential and operative in a first state to provide low impedance between said terminals and in a second state to provide a high impedance between said terminals, means response to said output to control said device to operate in said first state during said output to thereby load said line with said low impedance, latching means responsive to the operation of said device in said first state to provide an indication of said operation, an output terminal for applying said repetitive waveform received by said input terminal to any succeeding biasable sensor circuit connected to said loop, and means connecting said output terminal to said input terminal through selected portions of said biasable sensor circuit, and to said rectifier and said controllable impedance device.

19. The biasable sensor circuit according to claim 18, wherein said repetitive waveform is a square wave of a given repetition rate.

20. The biasable sensor according to claim 18, wherein said controllable impedance device is a transistor having an emitter electrode coupled to said line, a collector electrode coupled via a resistor to said point of reference potential and a base electrode for receiving said output to cause said transistor to exhibit said first impedance state.

21. The biasable sensor according to claim 20, wherein said latching means includes an LED device to provide a visual indication of said operation.

* * * * *